US010281873B2

(12) United States Patent
Makiguchi et al.

(10) Patent No.: US 10,281,873 B2
(45) Date of Patent: May 7, 2019

(54) DEVELOPING DEVICE, PROCESS CARTRIDGE, AND IMAGE FORMING APPARATUS

(71) Applicant: CANON KABUSHIKI KAISHA, Tokyo (JP)

(72) Inventors: Daisuke Makiguchi, Izunokuni (JP); Tatsuro Harada, Mishima (JP); Hiroki Shimizu, Suntou-gun (JP); Osamu Anan, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/878,118

(22) Filed: Jan. 23, 2018

(65) Prior Publication Data

US 2018/0210393 A1 Jul. 26, 2018

(30) Foreign Application Priority Data

Jan. 25, 2017 (JP) ..... 2017-011091

(51) Int. Cl.

*G03G 21/18* (2006.01)
*G03G 15/00* (2006.01)
*G03G 15/08* (2006.01)

(52) U.S. Cl.

CPC ..... *G03G 21/1814* (2013.01); *G03G 15/0806* (2013.01); *G03G 15/80* (2013.01); *G03G 21/185* (2013.01); *G03G 21/1825* (2013.01); *G03G 21/1867* (2013.01)

(58) Field of Classification Search

None

See application file for complete search history.

(56) References Cited

U.S. PATENT DOCUMENTS 5,943,529 A * 8/1999 Miyabe ..... G03G 21/1853 399/111
6,289,189 B1 * 9/2001 Numagami ..... G03G 21/186 399/111
6,389,250 B1 5/2002 Numagami et al.

(Continued)

FOREIGN PATENT DOCUMENTS

EP 3211484 A1 8/2017
JP 2013195805 A 9/2013

*Primary Examiner* — Sevan A Aydin

(74) *Attorney, Agent, or Firm* — Canon USA, Inc., IP Division

(57) ABSTRACT

A developing device, detachably mountable to an image forming apparatus main body, includes a developing frame containing a developer, a developing roller performing developing using the developer, and a plurality of electric contact points disposed at one end in an axial direction of the developing roller, on a face that intersects the axial direction. The developing device is pivotably centered on a pivot axis parallel to the axial direction of the developing roller, and electrically conducts with the image forming apparatus main body via the plurality of electric contact points when mounted to the image forming apparatus main body. In a plane perpendicular to the axial direction of the developing roller, a position of the pivot axis is within a polygon having a greatest area formed of outer shapes of the plurality of electric contact points and straight lines connecting the outer shapes of the multiple electric contact points.

10 Claims, 19 Drawing Sheets

(56) References Cited

U.S. PATENT DOCUMENTS

| | | | | |
|---|---|---|---|---|
| 7,162,174 | B2 * | 1/2007 | Suzuki | G03G 21/1814 399/111 |
| 7,346,293 | B2 * | 3/2008 | Suzuki | G03G 21/1814 399/111 |
| 8,213,828 | B2 * | 7/2012 | Murayama | G03G 21/1867 399/111 |
| 2007/0104511 | A1 * | 5/2007 | Kawai | F16D 1/101 399/167 |
| 2010/0189460 | A1 * | 7/2010 | Lee | G03G 21/1867 399/90 |
| 2011/0206412 | A1 * | 8/2011 | Tanabe | G03G 21/1842 399/111 |
| 2013/0114972 | A1 * | 5/2013 | Takarada | G03G 15/80 399/110 |
| 2014/0112679 | A1 * | 4/2014 | Choi | G03G 21/1652 399/90 |
| 2016/0139558 | A1 * | 5/2016 | Kawakami | G03G 21/1885 399/113 |
| 2017/0075293 | A1 * | 3/2017 | Fukasawa | G03G 21/1647 |
| 2017/0108828 | A1 * | 4/2017 | Asanuma | G03G 21/1867 |
| 2017/0185034 | A1 * | 6/2017 | Moon | G03G 21/1867 |
| 2017/0277119 | A1 * | 9/2017 | Sakai | G03G 21/1867 |
| 2018/0107155 | A1 * | 4/2018 | Shimizu | G03G 15/0865 |

* cited by examiner

DEVELOPING DEVICE, PROCESS CARTRIDGE, AND IMAGE FORMING APPARATUS

BACKGROUND

Field

The present disclosure relates to a developing device, a process cartridge, and an image forming apparatus, and is particularly suitable for an image forming apparatus using an electrophotographic image forming process. Examples of such image forming apparatuses include printers (laser beam printers, light-emitting diode (LED) printers, and so forth), copiers, facsimile devices, word processes, multifunctional apparatuses thereof (multifunction printers), and so forth.

Description of the Related Art

Conventionally, in image forming apparatuses using the electrophotographic image forming process, photosensitive drum and a processing arrangement that acts upon the photosensitive drum are fully or partly integrated into a cartridge. A process cartridge system, where this cartridge is detachably mountable to the main body of the image forming apparatus, is employed. According to this process cartridge system, users can perform maintenance of the image forming apparatus by exchanging process cartridges and developing devices, thereby markedly improving operability. Thus, this process cartridge system is in widespread use in electrophotographic image forming apparatuses.

One process arrangement acting upon the photosensitive drum is a developing roller that develops developer contained in the cartridge. This developing roller comes into contact with the photosensitive drum, thereby developing an electrostatic latent image formed on the photosensitive drum. However, if this developing roller remains in contact with the photosensitive drum for prolonged periods of time, the developing roller deforms, which affects image quality. Accordingly, a configuration is made where the developing roller comes into contact with the photosensitive drum only when forming images, and at other times is separated from the photosensitive drum, to suppress deformation of the developing roller.

Now, a conventional developing roller contact/separation operation will be described. FIG. 20A is a cross-sectional view of a process cartridge where a developing roller 25 is separated from a photosensitive drum 1. A shaft is inserted through a hole, omitted from illustration, that is provided in a developing frame 31, and a hole 27*b* provided in a cleaning frame 27, with the developing frame 31 being rotatably supported by the cleaning frame 27 with the shaft as a pivot center Y. A pressing member 32 provided to the image forming apparatus comes into contact with a pressed face 31*e* of the developing frame 31, whereby the developing roller 25 is urged in the direction of the arrow G, centered on the pivot center Y, and a state of separation from the photosensitive drum 1 is maintained.

Next, FIG. 20B is a cross-sectional view of the process cartridge when the developing roller 25 is in contact with the photosensitive drum 1. When the pressing member 32 moves in the direction of the arrow H, the developing frame 31 rotates in the direction of the arrow centered on the pivot center Y, under elastic force of a spring (omitted from illustration) provided to the developing frame 31. The developing roller 25 then comes into contact with the photosensitive drum 1, and further remains in contact with the photosensitive drum 1 at a predetermined pressure, by the elastic force of the spring.

In the process cartridge system, there is the need to supply electric power necessary for image formation from the image forming apparatus main body. As for the method of supplying electric power from the image forming apparatus to the process cartridge, an electroconductive elastic member, of which a metal spring provided to the image forming apparatus is representative, comes into contact with an electroconductive contact portion provided to the process cartridge at a predetermined pressure, thereby securing a conduction path. A different voltage needs to be applied in this supply of electric power, for each process arrangement provided to the process cartridge. Thus, the process cartridge needs multiple independent electric contacts, which necessitates a great amount of space for providing the electric contacts.

There conventionally is known an arrangement where multiple electric contacts are disposed at one end on the longitudinal direction of the process cartridge, and so as to overlap on the contact/separation path of the developing device, thereby realizing reduced size and stable electric power supply for the developing device (Japanese Patent Laid-Open No. 2013-195805).

The pivot center of the developing frame has been provided at one end side in a particular direction in a cross-section of the developing frame orthogonal to the longitudinal direction (the direction in which the shaft extends) of the process cartridge, in the conventional contact/separation configuration of the developing roller. The multiple electric contacts are disposed together at the other end side as to the shaft that is the pivot center, in a particular direction of the developing frame. Accordingly, there has been a problem that the developing frame becomes undesirably inclined due to pressure that the multiple electric contacts receive from the main body electric contacts provided to the image forming apparatus main body, and the pressure of the main body electric contact points decrease due to this inclination. Thus, there has been a need to set the pressure of the main body electric contact points taking into consideration this reduction in pressure.

It has been found desirable to provide a developing device, a process cartridge, and an image forming apparatus, capable of suppressing the inclination of the developing frame as to the pivot axis and perform stable electric power supply, when main body electric contacts come into contact with multiple electric contacts of the cartridge.

SUMMARY

A developing device according to aspects of the present invention, detachably mountable to an image forming apparatus main body, includes a developing frame configured to contain a developer, a developing roller configured to perform developing using the developer, and a plurality of electric contact points disposed at one end in an axial direction of the developing roller, on a face that intersects the axial direction. The developing device is pivotably centered on a pivot axis parallel to the axial direction of the developing roller, and electrically conducts with the image forming apparatus main body via the plurality of electric contact points when mounted to the image forming apparatus main body. In a plane perpendicular to the axial direction of the developing roller, a position of the pivot axis is within a polygon having a greatest area formed of outer shapes of the plurality of electric contact points and straight lines connecting the outer shapes of the multi electric contact points.

A process cartridge and image forming apparatus according to aspects of the present invention have the developing device.

Further features of aspects of the present invention will become apparent from the following description of exemplary embodiments with reference to the attached drawings.

DESCRIPTION OF THE EMBODIMENTS

Exemplary embodiments will be described in detail below, with reference to the attached drawings.

First Embodiment

Image Forming Apparatus

The overall configuration of an image forming apparatus 100 in which is mounted a developing cartridge (developing device) according to a first embodiment will be described with reference to FIG. 2. The developing cartridge according to the present embodiment is a configuration separate from a drum cartridge that has a photosensitive drum. Both are detachably mountable to the image forming apparatus main body (apparatus main body) 100A, and will be described in detail later.

Figure 2:
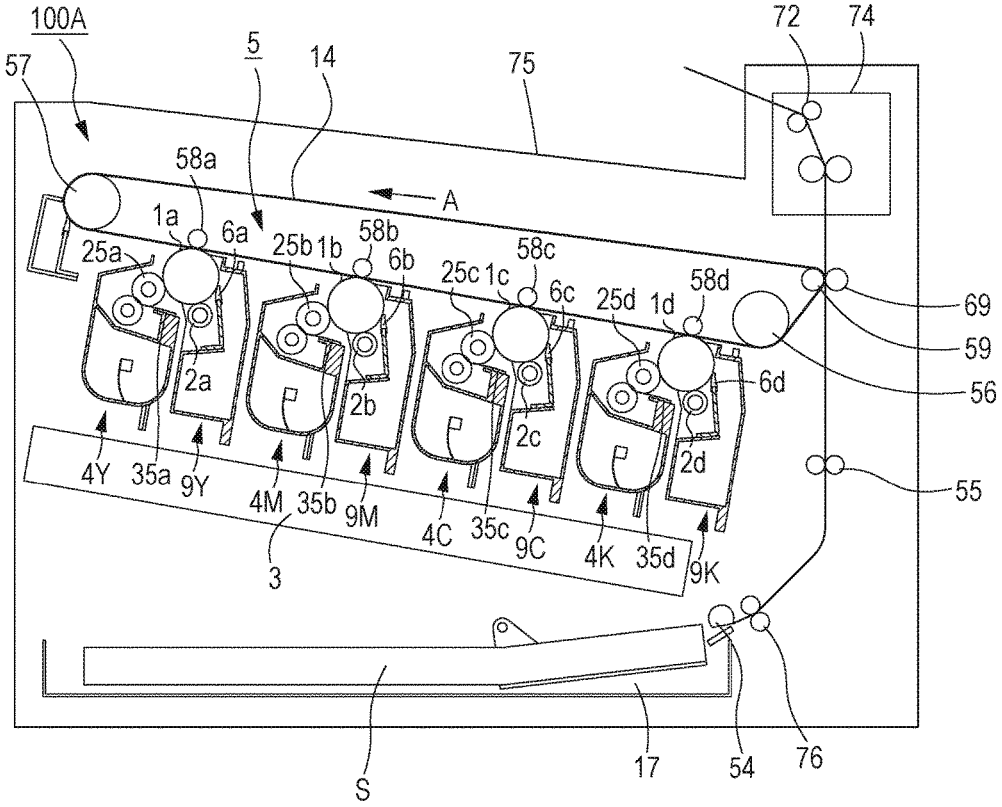
FIG. 2 is a principal section of an image forming apparatus in which is installed the developing cartridge according to the first embodiment.

In FIG. 2, four drum cartridges 9 (9Y, 9C, 9M, 9K) and four developing cartridges 4 (4Y, 4C, 4M, 4K), which are detachably mountable, are mounted via mounting members (omitted from illustration). Note that a developing cartridge 4Y containing yellow toner, a developing cartridge 4M containing magenta toner, a developing cartridge 4C containing cyan toner, and a developing cartridge 4K containing black toner, are of the same configuration.

In the same way, a developing cartridge 4Y containing yellow toner, a developing cartridge 4M containing magenta toner, a developing cartridge 4C containing cyan toner, and a developing cartridge 4K containing black toner, are of the same configuration. The upstream side in the mounting direction of the drum cartridges 9 and developing cartridges 4 as to the image forming apparatus 100 will be defined as a front face side, and the downstream side in the mounting direction as a back face side. The drum cartridges 9 and developing cartridges 4 in FIG. 2 are provided in tandem within the apparatus main body 100A, inclined as to the horizontal direction.

The drum cartridges 9 (9Y, 9C, 9M, 9K) are integrally provided with process arrangements in the vicinity thereof, such as charging rollers 2 (2*a*, 2*b*, 2*c*, 2*d*), cleaning members 6 (6*a*, 6*b*, 6*c*, 6*d*) and so forth, besides the photosensitive drums 1 (1*a*, 1*b*, 1*c*, 1*d*). The developing cartridges 4 (4Y, 4M, 4C, 4K) are also integrally provided with process arrangements such as developing blades 35 (35*a*, 35*b*, 35*c*, 35*d*) and so forth, besides the developing rollers 25 (25*a*, 25*b*, 25*c*, 25*d*). Note that in the following description, members of which there are a plurality may be referred to individually in single form, collectively in single form, or as a plurality, depending on context.

The charging roller 2 uniformly charges the surface of the photosensitive drum 1, and the developing roller 25 develops and visualizes a latent image formed on the photosensitive drum 1 by toner. The cleaning member 6 transfers the toner image formed on the photosensitive drum 1 onto a recording medium, and thereafter removes residual toner remaining on the photosensitive drum 1. A scanner cartridge 3 that selectively exposes the photosensitive drum 1 based on image information and forms the latent image on the photosensitive drum 1 is disposed below the drum cartridge 9 and developing cartridge 4.

A cassette 17 storing a recording medium S is mounted at a lower portion of the apparatus main body 100A. A recoding medium conveying arrangement is provided, such as the recording medium S is conveyed past a secondary transfer roller 69 and fixing unit 74 and to an upper portion of the apparatus main body 100A. That is to say, provided are a feed roller 54 that separates and feeds the recording medium S within the cassette 17 one sheet at a time, a conveying roller pair 76 that conveys the fed recording medium S, and a registration roller pair 55 for synchronization between the latent image formed on the photosensitive drum 1 and the recording medium S.

An intermediate transfer cartridge 5 serving as an intermediate transfer arrangement, for transferring toner images formed on the photosensitive drums 1 (1*a*, 1*b*, 1*c*, 1*d*), is disposed above the drum cartridge 9 and developing cartridge 4. The intermediate transfer cartridge 5 is provided with a driving roller 56, a driven roller 57, primary transfer rollers 58 (58*a*, 58*b*, 58*c*, 58*d*) at positions facing the respective color photosensitive drums 1, and a facing roller 59 facing the secondary transfer roller 69. A transfer belt 14 runs over these rollers.

The transfer belt 14 moves cyclically facing and. coming into contact with all photosensitive drums 1. Primary transfer from the photosensitive drums 1 to the transfer belt 14 is performed by applying voltage to the primary transfer rollers 58 (58*a*, 58*b*, 58*c*, 58*d*). Applying voltage to the facing roller 59 disposed on the inner side of the transfer belt 14, and the secondary transfer roller 69, transfers the toner on the transfer belt 14 onto the recording medium S.

When forming an image, each photosensitive drum 1 is rotated, and the photosensitive drums 1 uniformly charged by the charging rollers 2 are selectively exposed by the scanner cartridges 3. Thus, electrostatic latent images are formed on the photosensitive drums 1. The latent images are then developed by the developing rollers 25. This forms toner images of the respective colors on the respective photosensitive drums 1. The toner images on the photosensitive drums 1 are then overlaid on the transfer belt 14 by primary transfer. Synchronously with this image formation, the registration roller pair 55 conveys the recording medium S to a secondary transfer position (a position where the facing roller 59 and the secondary transfer roller 69 are in contact across the transfer belt 14).

Secondary transfer of the toner images on the transfer belt 14 onto the recording medium S is performed by applying transfer bias voltage to the secondary transfer roller 69. This forms a color image on the recording medium S. The recording medium S on which the color image has been formed is heated and pressurized by the fixing unit 74, thereby fixing the toner image. Thereafter, the recording medium S is discharged to a discharge unit 75 by a discharge roller pair 72. Note that the fixing unit 74 is disposed at the upper portion of the apparatus main body 100A.

Drum Cartridge

Figure 3:
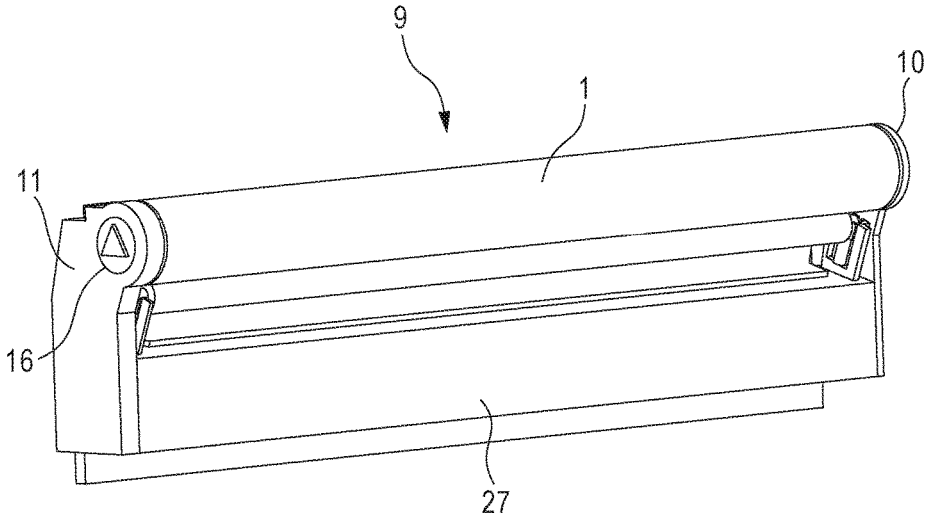
FIG. 3 is an explanatory diagram of a drum cartridge according to a first image forming apparatus.

The drum cartridge 9 according to the present image forming apparatus will be described with reference to FIGS. 3 and 4. The photosensitive drum 1 is rotatably disposed to the cleaning frame 27 of the drum cartridge 9 (9Y, 9M, 9C, 9K) via a drum-front bearing 10 and a drum-rear bearing 11, as illustrated in FIG. 3. A drum coupling 16 is provided at one end side on the axial direction of the photosensitive drum 1.

Figure 4:
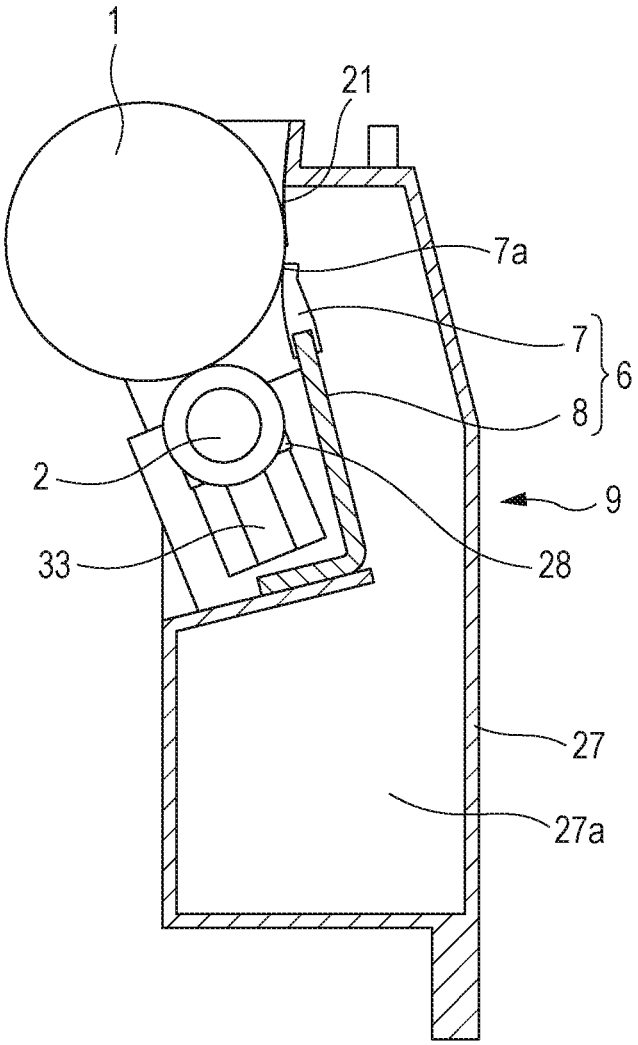
FIG. 4 is a principal section of the drum cartridge according to the first image forming apparatus.

FIG. 4 is a cross-sectional view of the drum cartridge 9. The cleaning frame 27 is provided with the photosensitive drum 1, charging roller 2, and cleaning member 6. The charging roller 2 and cleaning member 6 are disposed in the vicinity of the photosensitive drum 1. More specifically, the charging roller 2 is rotatably attached to the drum cartridge 9 via a charging roller bearing 28, and is pressured toward the photosensitive drum 1 by a charging roller pressuring member 33. Thus, the photosensitive drum 1 is rotationally driven in accordance with image forming operations, by transmitting driving force of a main body driving motor (omitted from illustration) that is a driving source to the drum cartridge 9, and the charging roller 2 rotates following the photosensitive drum 1.

The cleaning member 6 is configured of an elastic member made of a rubber blade 7, and a cleaning support member 8. A tip portion 7*a* of the rubber blade 7 is disposed in contact with the photosensitive drum 1, facing a direction countering the rotation direction of the photosensitive drum 1. Residual toner removed from the surface of the photosensitive drum 1 by the cleaning member 6 falls into a waste toner chamber 27*a* of the cleaning frame 27. A scoop sheet 21 that prevents waste toner in the waste toner chamber 27*a* from leaking is fixed to the cleaning frame 27 so as to come into contact with the photosensitive drum 1.

Developing Cartridge

Next, the developing cartridge 4 serving as a developing device will be described with reference to FIGS. 5 and 1B. The term "developing device" as used here means a device that developed an electrostatic latent image formed on a photosensitive drum using a developer, and is configured including a developing arrangement, a developing frame supporting the developing arrangement, parts relating to the developing arrangement, and so forth. Examples of the developing arrangement include a developing roller, applying roller, developing blade, and so forth.

Figure 5:
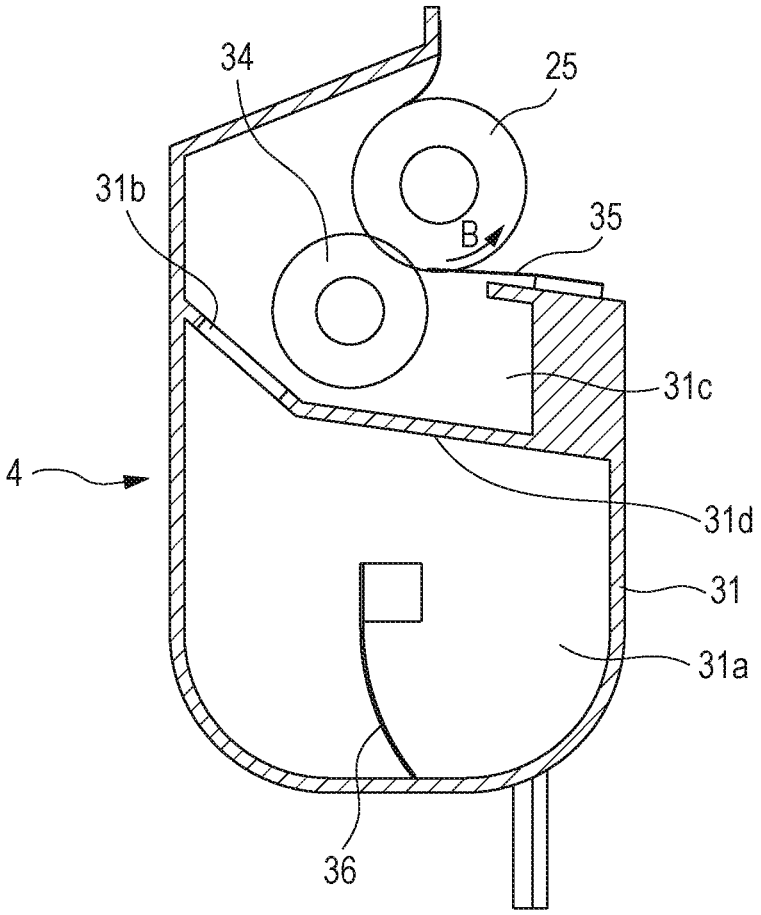
FIG. 5 is a principal section of the developing cartridge according to the first embodiment.

FIG. 5 is a cross-sectional view orthogonal to the insertion direction of the developing cartridge 4 (4Y, 4M, 4C, 4K) storing toner (developer). FIG. 1B is a disassembled configuration diagram of the developing cartridge 4.

The developing cartridge 4 has, in the developing frame 31, the developing roller 25 that rotates in the direction of the arrow B in contact with the photosensitive drum 1, a toner supply roller 34 that rotates in contact with the developing roller 25, the developing blade 35 that regulates toner on the developing roller 25, and a conveying member 36.

The developing frame 31 includes a developing chamber 31*c* where the developing roller 25 is disposed, and a toner storage chamber 31*a* provided below the developing chamber 31*c*. These chambers are partitioned by a partition 31*d*. The partition 31*d* is provided with an opening 31*b* that toner passes through when conveying toner from the toner storage chamber 31*a* to the developing chamber 31*c*. The toner storage chamber 31*a* of the developing frame 31 is provided with the conveying member 36 that agitates the stored toner, and also conveys toner to the developing chamber 31*c* via the opening 31*b*.

The toner supply roller 34 is provided in parallel with the axial direction of the developing roller 25 (FIG. 5). The developing roller 25 and toner supply roller 34 are rotatably supported by the developing frame 31, via a developing unit front bearing 12 and a developing unit rear bearing 13, serving as supporting members or supporting frames illustrated in FIG. 1B.

Figure 1A:
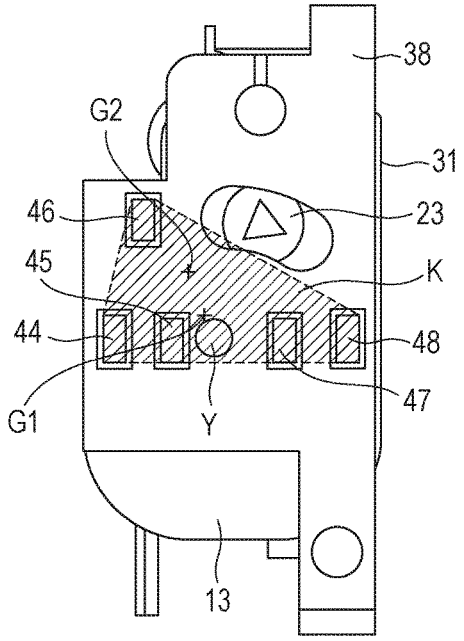
FIGS. 1A and 1B are explanatory diagrams of the configuration of a developing cartridge according to a first embodiment.
Figure 1B:
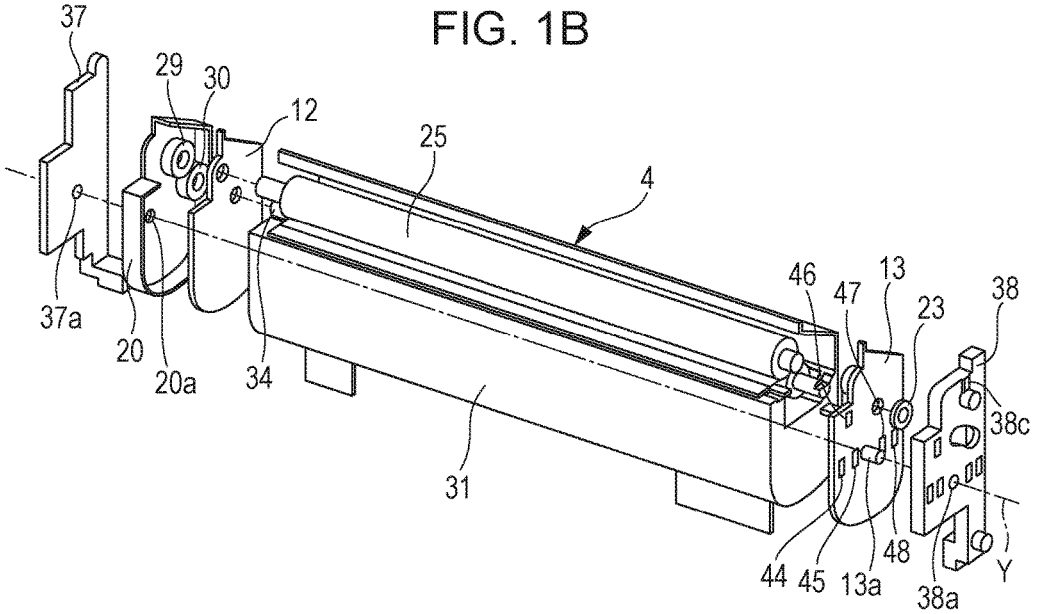

Now, a developing unit coupling 23 is provided at the back side portion of the toner supply roller 34, as illustrated in FIG. 1B. Thus, the driving force of the main body driving motor (omitted from illustration) that is the driving source, is transmitted from the developing unit coupling 23 to the toner supply roller 34.

On the other hand, a toner supply gear 30 is provided at the front end portion of the toner supply roller 34. A developing unit gear 29 that meshes with the toner supply gear 30 is provided on the front end portion of the developing roller 25. Accordingly, the driving force of the main body driving motor can be transmitted to the developing unit coupling 23, and the toner supply roller 34 and developing roller 25 can be rotationally driving in accordance with image forming operations. A gear cover 20 that is part of the developing frame 31 is provided on the outer side of the developing unit gear 29 and toner supply gear 30.

As illustrated in FIG. 1B, a front-side end member 37 and a back-side end member 38 are further provided to one end and the other end of the developing frame 31 in the developing roller axial direction. A hole 38*a* that engages a boss 13*a* provided to the developing unit rear bearing 13 is provided in the back-side end member 38. A hole 37*a* that engages a boss 20*a* provided to the gear cover 20 is provided in the front-side end member 37. The front-side end member 37 and back-side end member 38 are rotatably attached as to an axis Y connecting the boss 13*a* of the developing unit rear bearing 13 and the boss 20*a* of the gear cover 20. Thus, the front-side end member 37 and back-side end member 38 are independently rotatable as to the developing frame 31.

Inserting Drum Cartridge and Developing Cartridge into Apparatus Main Body

Figure 6:
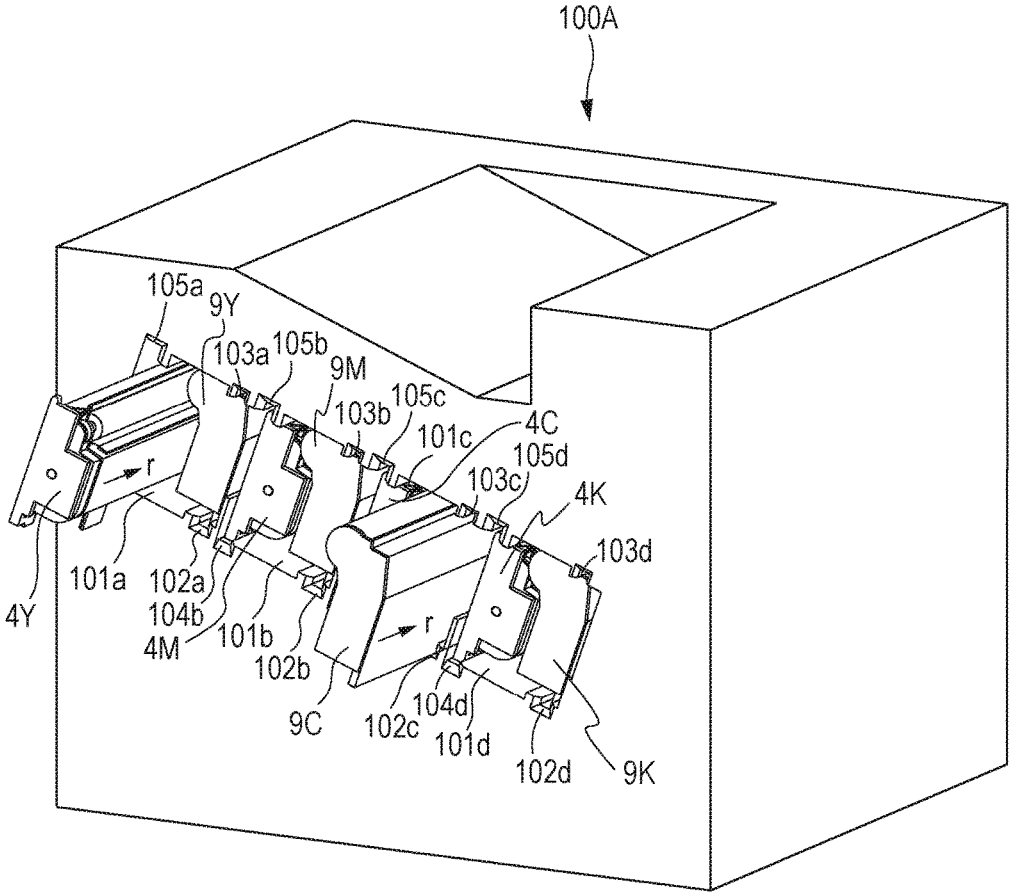
FIG. 6 is a configuration diagram of mounting the developing cartridge and drum cartridge according to the first embodiment.

Next, a configuration for inserting the drum cartridge 9 and developing cartridge 4 into the apparatus main body 100A will be described with reference to FIG. 6. Note that in the present embodiment, the configuration of inserting the drum cartridge 9 and developing cartridge into an opening portion 101 (101*a*, 101*b*, 101*c*, 101*d*) of the apparatus main body 100A is a configuration where the direction of insertion is a direction (direction of arrow F) parallel to the axial direction of the photosensitive drum 1 (1*a*, 1*b*, 1*c*, 1*d*). Further, the configuration is such that the drum cartridge 9 and developing cartridge 4 are inserted from the front side toward the back side. The upstream side of the insertion direction of the drum cartridge 9 and developing cartridge 4 is defined as the front side in the present embodiment, and the downstream side as the back side.

A main body mounting upper guide portion 103 (103*a*, 103*b*, 103*c*, 103*d*), which is a first main body guide portion, is disposed at the upper side within the apparatus main body 100A, and a main body mounting lower guide portion 102 (102*a*, 102*b*, 102*c*, 102*d*), which is a second main body guide portion, is disposed at the lower side. The main body mounting upper guide portion 103 and main body mounting lower guide portion 102 are each guide forms extending along the insertion direction F of the drum cartridge 9. The drum cartridge 9 is loaded on the front side in the mounting direction of the main body mounting lower guide portion 102, and moved along the main body mounting upper guide portion 103 and main body mounting lower guide portion 102 in the insertion direction F, and thus is inserted into to the apparatus main body 100A.

The developing cartridge 4 is also inserted into the apparatus main body 100A in the same way as the drum cartridge 9. A main body mounting upper guide portion 105 (105*a*, 105*b*, 105*c*, 105*d*), which is a third main body guide portion, is disposed at the upper side within the apparatus main body 100A, and a main body mounting lower guide portion 104 (104*a*, 104*b*, 104*c*, 104*d*), which is a fourth main body guide portion, is disposed at the lower side. The main body mounting upper guide portion 105 and main body mounting lower guide portion 104 are each guide forms extending along the insertion direction F of the developing cartridge 4. The developing cartridge 4 is loaded on the front side in the mounting direction of the main body mounting lower guide portion 104, and moved along the main body mounting upper guide portion 105 and main body mounting lower guide portion 104 in the insertion direction F, and thus is inserted into to the apparatus main body 100A.

Figure 7A:
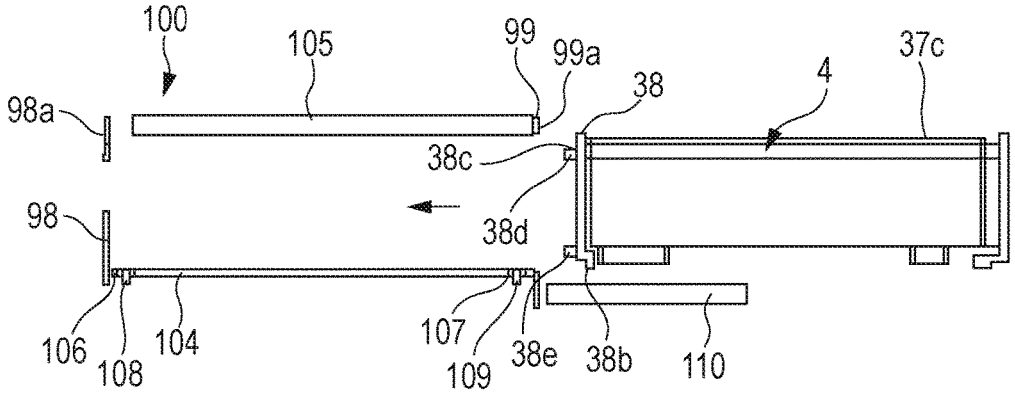
FIGS. 7A through 7C are explanatory diagrams of operations when mounting the developing cartridge according to the first embodiment to the image forming apparatus main body.
Figure 7B:
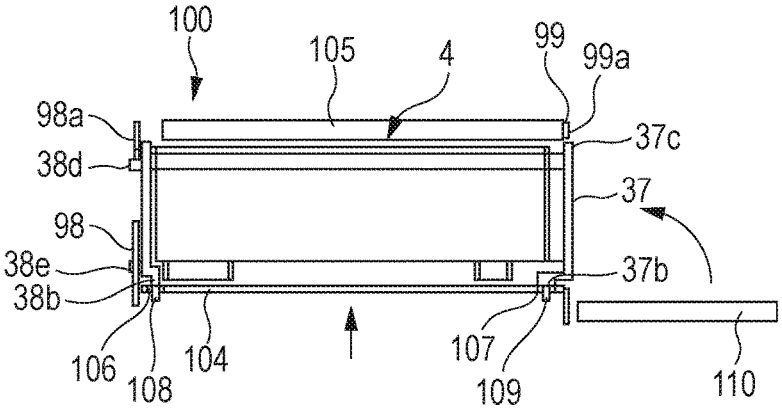

Next, the operations of mounting the developing cartridge 4 to the apparatus main body 100A will be described with reference to FIGS. 7A through 8. FIG. 7A is a diagram for describing a state before mounting the developing cartridge 4 to the apparatus main body 100A. FIG. 7B is a diagram for describing a state where the developing cartridge 4 has been mounted until abutting a back-side plate 98 of the apparatus main body 100A. The main body mounting lower guide portion 104 provided to the apparatus main body 100A has a back-side main body pressuring member 106, a back-side main body pressuring spring 108, a front-side main body pressuring member 107, and a front-side main body pressuring spring 109, for pressuring and positioning the developing cartridge 4 as to the apparatus main body 100A.

When mounting the developing cartridge 4 to the apparatus main body 100A, an insertion guide portion 38*b* of the back-side end member 38 rides up on the back-side main body pressuring member 106, and an insertion guide portion 37*b* of the front-side end member 37 rides up on the front-side main body pressuring member 107. Thus, the developing cartridge 4 moves upwards in the vertical direction of the apparatus main body 100A.

Figure 7C:
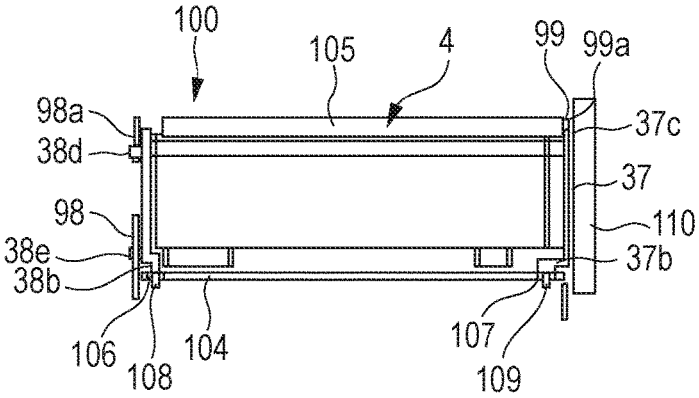

An abutting portion 38*c* provided to the back-side end member 38 abuts the back-side plate 98 of the apparatus main body 100A, thereby positioning the developing cartridge 4 in the insertion direction. FIG. 7C is a diagram for describing a state where the developing cartridge 4 has been positioned as to the apparatus main body 100A. A front door 110 of the apparatus main body 100A is closed, and in conjunction with this, the main body mounting lower guide portion 104 that has the main body pressuring members 106 and 107 and the main body pressuring springs 108 and 109 moves upwards in the vertical direction of the apparatus main body 100A.

In conjunction with this, a back-side positioning portion 38*d* provided to the back-side end member 38 comes into contact with a positioning portion 98*a* that is a main body positioning portion of the back-side plate 98. Further, a front-side positioning portion 37*c* provided to the front-side end member 37 comes into contact with a positioning portion 99*a* that is a main body positioning portion of a front-side plate 99. Thus, the developing cartridge 4 is positioned as to the apparatus main body 100A.

Figure 8:
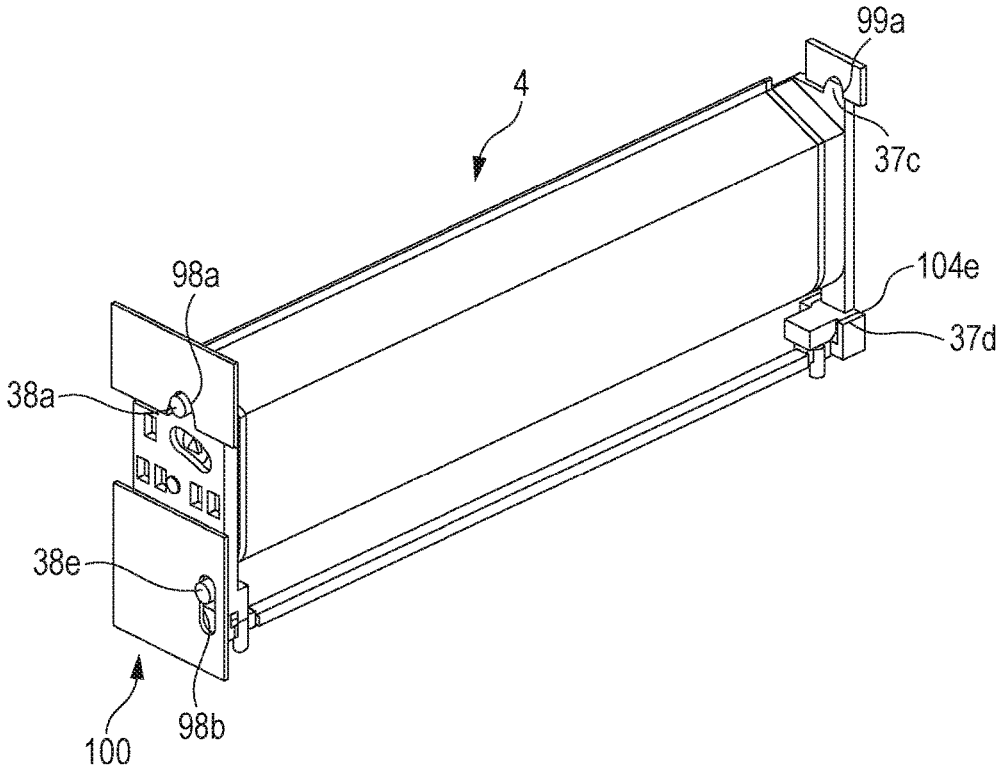
FIG. 8 is a configuration explanatory diagram illustrating a state in which the developing cartridge according to the first embodiment is positioned as to the image forming apparatus main body.

Further, a boss 38*e* serving as a rotation stopper for the back-side end member 38 is provided to the back-side end member 38 as illustrated in FIG. 8, the boss 38*e* fitting to a rotating stopping hole 98*b* provided to the back-side plate 98. This prevents the back-side end member 38 from rotating within the apparatus main body 100A. In the same way, a rotation stopper 37*d* serving as a rotation stopper for the front-side end member 37 is provided to the front-side end member 37 as well, and fits to a rotation stopper portion

104*e* provided to the main body mounting lower guide portion 104. Accordingly, the front-side end member 37 is prevented from rotating within the apparatus main body 100A.

Thus, the back-side end member 38 and front-side end member 37 of the developing cartridge 4 is fixed to the apparatus main body 100A by mounting the developing cartridge 4 to the apparatus main body 100A, and the developing frame 31 can pivot as to the apparatus main body 100A.

Contact/Separation Operations

Figure 9A:
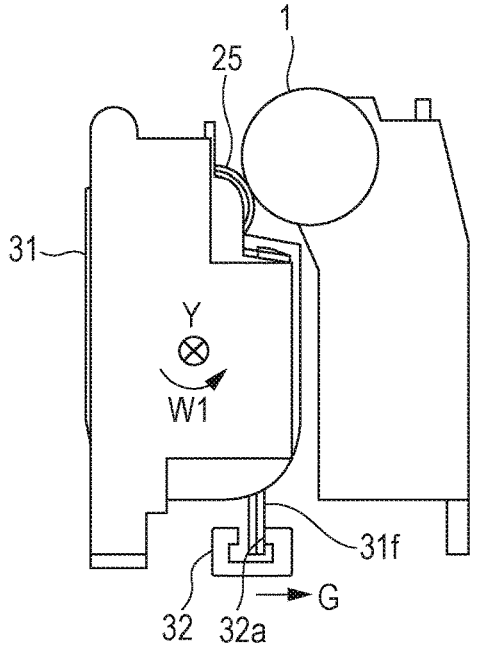
FIGS. 9A and 9B are explanatory diagrams of operations regarding a separation operation of the developing cartridge according to the first embodiment.
Figure 9B:
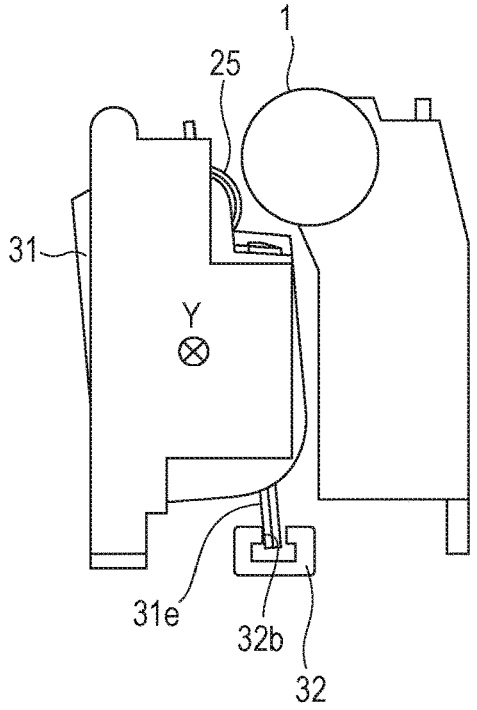

Next, the contact/separation operations of the photosensitive drum 1 and developing roller 25 will be described. FIGS. 9A and 9B are diagrams for describing separation operations of the developing cartridge 4. A separation member 32 is provided to the apparatus main body 100A at a predetermined position in the longitudinal direction of the developing cartridge 4.

Urging force is applied to the developing roller 25 when forming images, by a contact force pressuring portion 32*a* of the separation member 32 coming into contact with a contact force receiving portion 31*f* of the developing frame 31, and thus the developing roller 25 is in a state of being in contact with the photosensitive drum 1. However, when the separation member 32 moves in the direction of the arrow G, the contact state of the contact force pressuring portion 32*a* of the separation member 32 and the contact force receiving portion 31*f* of the developing frame 31 is disengaged first.

As the separation member 32 moves further in the direction of the arrow G, a separation force pressuring portion 32*b* of the separation member 32 comes into contact with a separation force receiving portion 31*e* of the developing frame 31, and as the separation member 32 moves in the direction of the arrow G, the developing frame 31 rotates in the direction of arrow W1, centered on the axis Y. As a result, the developing roller 25 moves to a position separated from photosensitive drum 1.

Figure 10A:
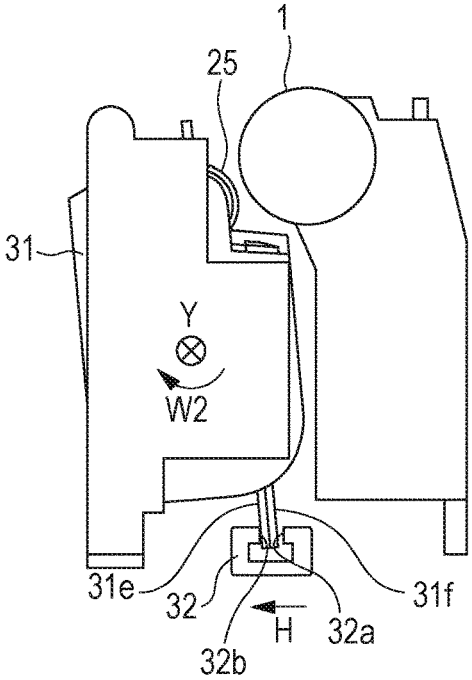
FIGS. 10A and 10B are explanatory diagrams of operations regarding a contact operation of the developing cartridge according to the first embodiment.
Figure 10B:
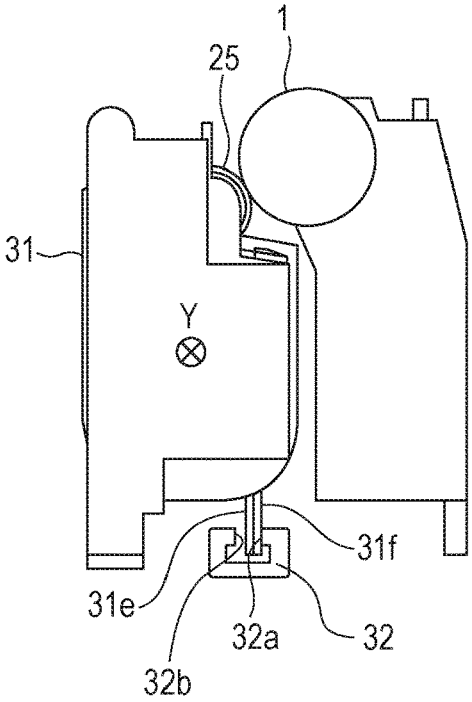

Next, FIGS. 10A and 10B are diagrams describing contact operations of the developing cartridge 4. When the separation member 32 moves in the direction of the arrow H, the contact state between the separation force pressuring portion 32*b* of the separation member 32 and the separation force receiving portion 31*e* of the developing frame 31 is disengaged first. As the separation member 32 further moves in the direction of the arrow H, the contact force pressuring portion 32*a* of the separation member 32 comes into contact with the contact force receiving portion 31*f* of the developing frame 31, and the developing frame 31 rotates in the direction of arrow W2, centered on the axis Y. As a result, the developing roller 25 moves to a position in contact with photosensitive drum 1.

Due to this configuration, after contact, the developing roller 25 comes into contact with the photosensitive drum 1 at a predetermined pressure, by a pressuring mechanism (omitted from illustration) provided to the separation member 32. Also, the developing cartridge 4 moves to a contact position with the photosensitive drum 1 when forming images, and otherwise moves to and is kept at a separation position, due to this contact/separation mechanism. Accordingly, effects on image quality due to deformation of the developing roller 25 can be suppressed.

Electric Power Supply to Developing Cartridge 4

Figure 11:
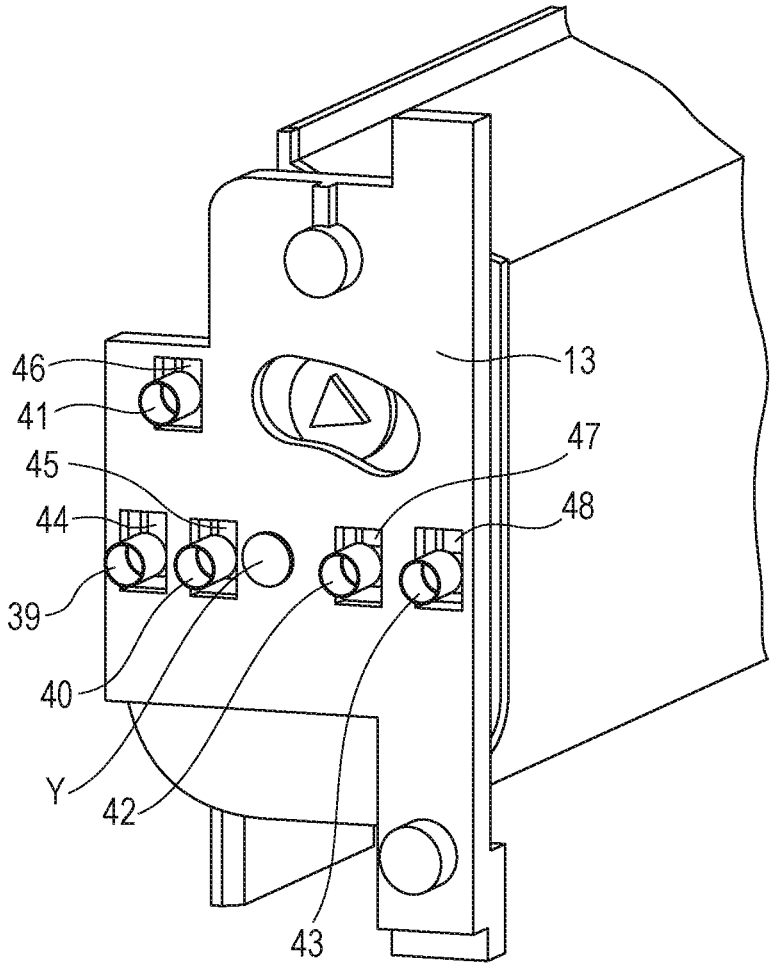
FIG. 11 is a configuration explanatory diagram for describing the electricity conducting method of the developing cartridge and image forming apparatus main body according to the first embodiment.

Next, the configuration for supplying electric power to the developing cartridge 4 according to the present embodiment will be described. FIG. 11 is a schematic diagram at the back side when the developing cartridge 4 is mounted to the apparatus main body 100A. Multiple developing unit side electric contact points that come into contact with main body side electric contact points 39, 40, 41, 42, and 43, are provided on the developing unit rear bearing 13. These are a developing roller contact point 44, toner supply roller contact point 45, developing blade contact point 46, and residual toner detection contact points 47 and 48.

These multiple electric contact points (44, 45, 46, 47, 48) are formed of an electroconductive resin material. These are integrally formed with the developing unit rear bearing 13 disposed at one end of the developing roller 25 in the axial direction (longitudinal direction), and are provided on a face intersecting the axial direction of the developing roller 25.

Now, the configuration for applying voltage to the developing roller 25 and toner supply roller 34 and the configuration for applying voltage to the developing blade 35 and a residual toner detecting unit (omitted from illustration) are the same configuration. Accordingly, the configuration for applying voltage to the developing roller 25 and the developing blade 35 will be exemplified in the description of the configuration for applying voltage to the developing cartridge 4.

Figure 12:
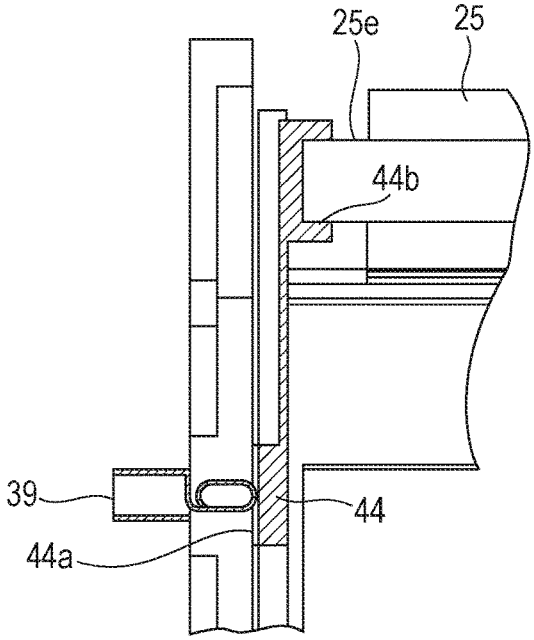
FIG. 12 is a cross-sectional view for describing the electricity conducting method of the developing roller of the developing cartridge and the image forming apparatus main body, according to the first embodiment.

FIG. 12 is a cross-sectional view illustrating the configuration for supplying electric power from the main body side electric contact point 39 to the developing roller 25. The developing roller contact point 44 has a first contact face 44*a* that comes into contact with the main body side electric contact point 39, and a second contact face 44*b* that comes into contact with a developing roller core 25*e*. The first contact face 44*a* is provided on the back side of the developing unit rear bearing 13, and is in contact with the main body side electric contact point 39 under a predetermined amount of pressure. The second contact face 44*b* rotatably supports the developing roller core 25*e*, and is in contact with the peripheral face and end face of the developing roller core 25*e*. Upon voltage being output to the main body side electric contact point 39 under an instruction from a controller (omitted from illustration) of the apparatus main body 100A, voltage is applied to the surface of the developing roller 25 via the developing roller contact point 44 and the developing roller core 25*e*.

Figure 13:
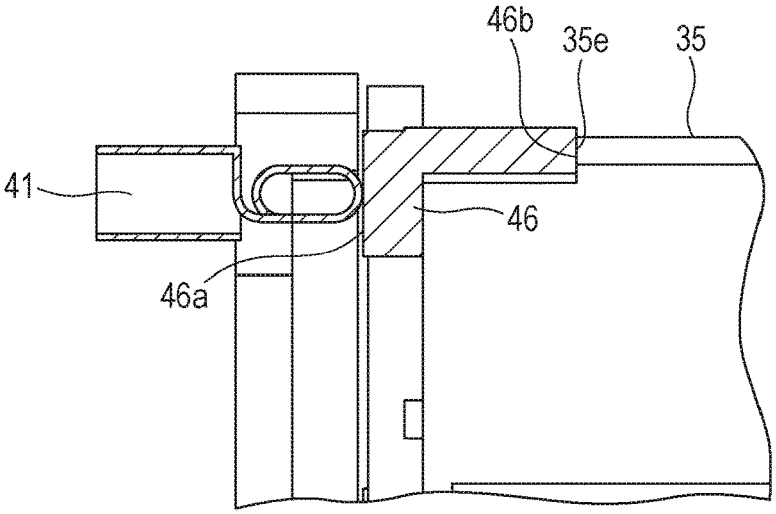
FIG. 13 is a cross-sectional view for describing the electricity conducting method of the developing blade of the developing cartridge and the image forming apparatus main body, according to the first embodiment.

FIG. 13 is a cross-sectional view illustrating the configuration for supplying electric power from the main body side electric contact point 41 to the developing blade 35. The developing blade contact point 46 has a first contact face 46*a* that comes into contact with the main body side electric contact point 41, and a second contact face 46*b* that comes into contact with a developing blade supporting plate 35*e*. The first contact face 46*a* is provided on the back side of the developing unit rear bearing 13, and is in contact with the main body side electric contact point 41 under a predetermined amount of pressure. Upon voltage being output to the main body side electric contact point 41 under an instruction from a controller (omitted from illustration) of the apparatus main body 100A, voltage is applied to the developing blade 35 via the developing blade contact point 46 and the developing blade supporting plate 35*e*.

Now, description has been made in the present embodiment where an electroconductive resin material is used for the members that electrically conduct from main body side electric contact points to the developing roller 25 and developing blade 35. However, it is sufficient for electrical connection to the process members to be realized, and there is no particular restriction regarding the materials or arrangements thereof.

Layout of Axis Y of Developing Cartridge and Developing Unit Side Electric Contact Points 44 through 48, and End Member of Developing Device The layout of the Y axis that is the axis of rotation (pivot axis) of the developing cartridge 4 according to the present embodiment, and the developing roller contact point 44, toner supply roller contact point 45, developing blade contact point 46, and residual toner detection contact points 47 and 47 that are developing unit side electric contact points will be described. The developing unit rear bearing 13 provided at the end side of the developing device (developing cartridge) will also be described in relation with this. FIG. 1A is a configuration diagram of the back end portion of the developing cartridge 4, and FIG. 1B is a disassembled configuration diagram of the developing cartridge 4.

The axis Y of the developing frame 31 is laid out as illustrated in FIG. 1A, in plan view perpendicular to the axial direction of the developing roller 25. That is to say, the axis Y is disposed within a polygonal region (having an area of K) formed of the outer shapes of the developing roller contact point 44, toner supply roller contact point 45, developing blade contact point 46, and residual toner detection contact points 47 and 48, and straight lines connecting these outer shapes.

In FIG. 1B, a boss 13*a* serving as the axis Y of the developing cartridge 4, and multiple electric contact points (44, 45, 46, 47, and 48) are provided on the developing unit rear bearing 13 of the developing cartridge 4. The boss 13*a* is provided within a polygonal region having the greatest area formed of the outer shapes of the multiple electric contact points and straight lines connecting the outer shapes of the multiple electric contact points, in a plane perpendicular to the axis Y. Accordingly, in a case of a layout of developing unit side electric contact points such as illustrated in FIG. 1A, a polygon having the greatest area is formed by using all developing unit side electric contact points.

Figure 14:
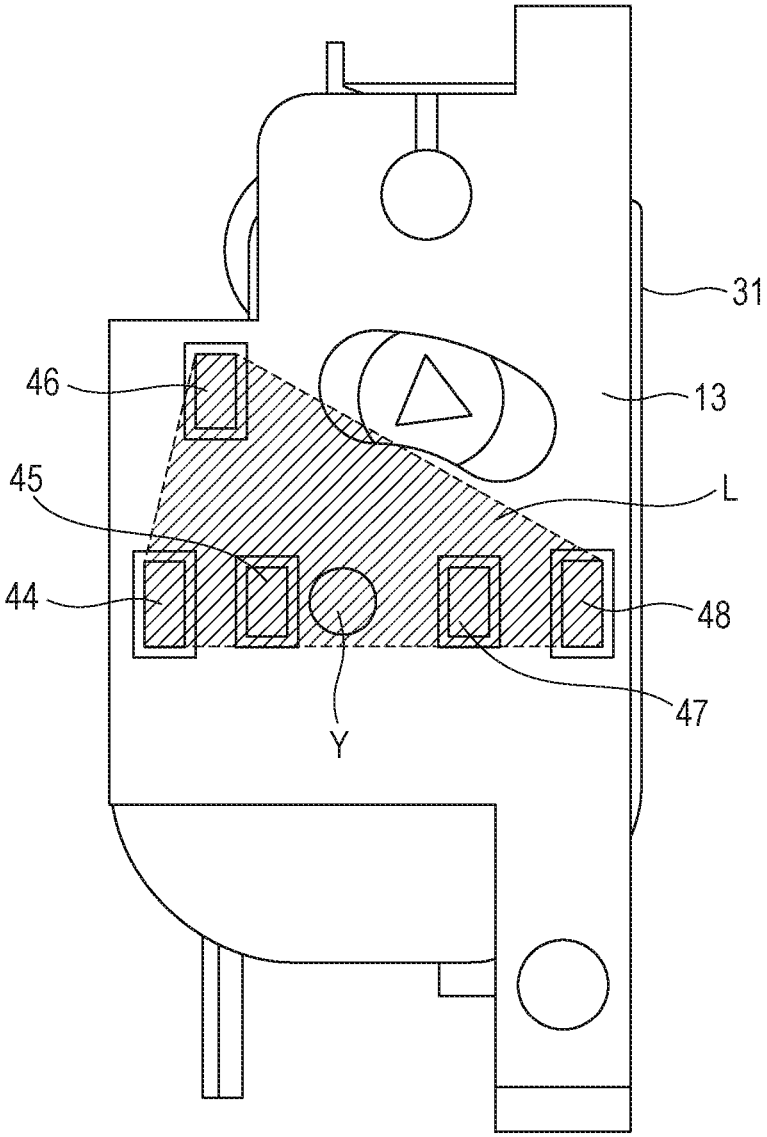
FIG. 14 is a configuration diagram of a developing cartridge according to a modification of the first embodiment.

In a case of a layout of developing unit side electric contact points such as illustrated in FIG. 14, a polygon having the greatest area (area L of hatched portion) is formed by using the outer shapes of the developing roller contact point 44, developing blade contact point 46, and residual toner detection contact point 48, which is part of all developing unit side electric contact points, and straight lines connecting these outer shapes.

The developing unit side electric contact points necessary for forming a polygon are thus selected in the present embodiment such that a polygon having the greatest area is formed an a plane perpendicular to the axis Y. Accordingly, there may be cases where all developing unit side electric contact points are used for forming the polygon (FIG. 1A), and there may be cases where only a part is used (FIG. 14).

Figure 15:
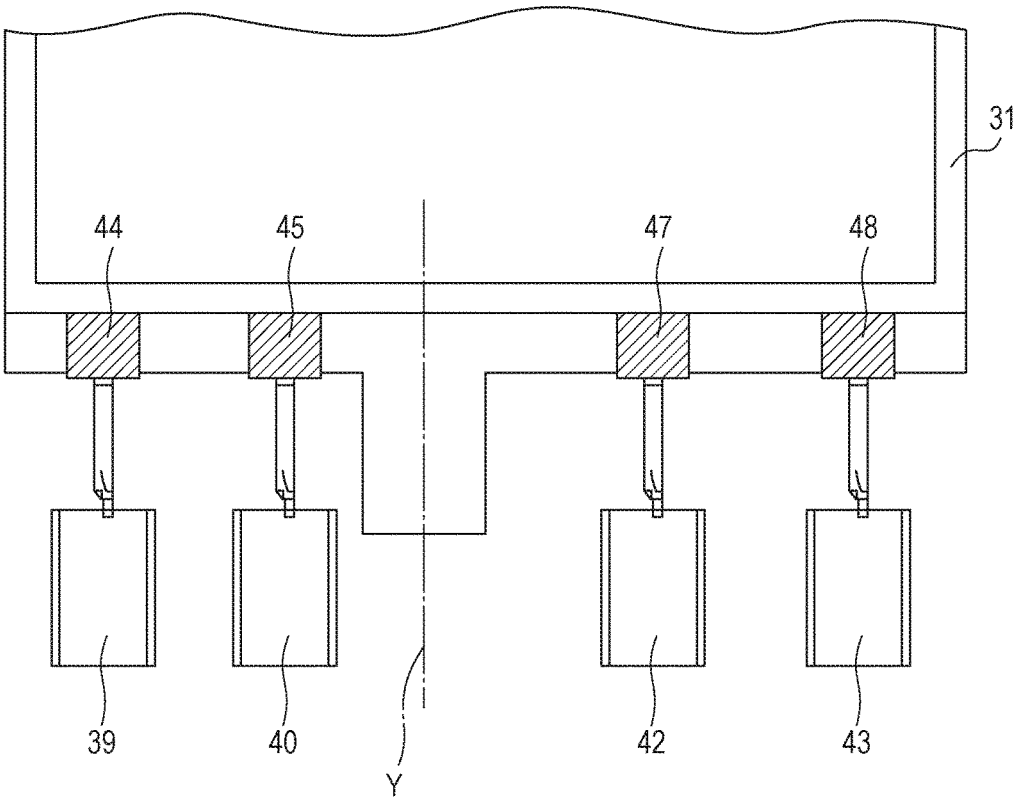
FIG. 15 is an explanatory diagram illustrating a layout where developing-side electric contacts face each other with a pivot axis as the center.

Thus, due to the axis Y being disposed in a polygonal region, the developing unit side electric contact points are laid out so that the axis Y is interposed therebetween. Accordingly, when urging force is received from the main body side electric contact points 39, 40, 42 and 43, as illustrated in FIG. 15, force is applied symmetrically with regard to the axis Y. That is to say, the situation in conventional arrangements, where the developing frame 31 inclines as to the axis Y under pressure that the multiple electric contact points receive from main body electric contact points provided to the image forming apparatus main body, and the pressure of the main body electric contact points decreases due to the inclination, can be suppressed. As a result, stable voltage application from the apparatus main body 100A to each process arrangement can be realized, without having to set the pressure of the main body electric contact points taking into consideration reduction in pressure.

Suppressing the inclination of the developing frame 31 as to the axis Y enables the below-described sliding resistance to be suppressed when the developing frame 31 pivots during the contact/separation operations illustrated in FIGS. 9 and 10. Specifically, sliding resistance between the boss 13*a* of the developing unit rear bearing 13 and the hole 38*a* of the back-side end member 38, and the boss 20*a* of the gear cover 20 and the hole 37*a* of the front-side end member 37, can be reduced. Accordingly, the pressure when pressing the developing roller 25 into contact with the photosensitive drum 1 is stabilized, so image quality can be improved.

The axis Y of the developing frame 31 is situated in the vicinity of a center-of-gravity position G1 when the developing frame 31 is maximally filled with developer, and a center-of-gravity position G2 when no developer is stored in the developing frame 31, as viewed in a plane perpendicular to the axial direction of the developing roller 25. Specifically, the center-of-gravity positions G1 and G2 are within the above-described polygonal region.

Thus, positioning the axis Y near the center of gravity of the developing frame 31 enables the effects of moment generated by the weight of the developing frame 31 during the contact/separation operations of the developing roller 25 as to the photosensitive drum 1 can be reduced. Accordingly, the moment necessary for turning (pivoting) the developing frame 31 during contact/separation operations of the separation member 32 illustrated in FIGS. 9 and 10 can be reduced, so the output pressure of the pressuring mechanism of the separation member 32 can be small.

Figure 16:
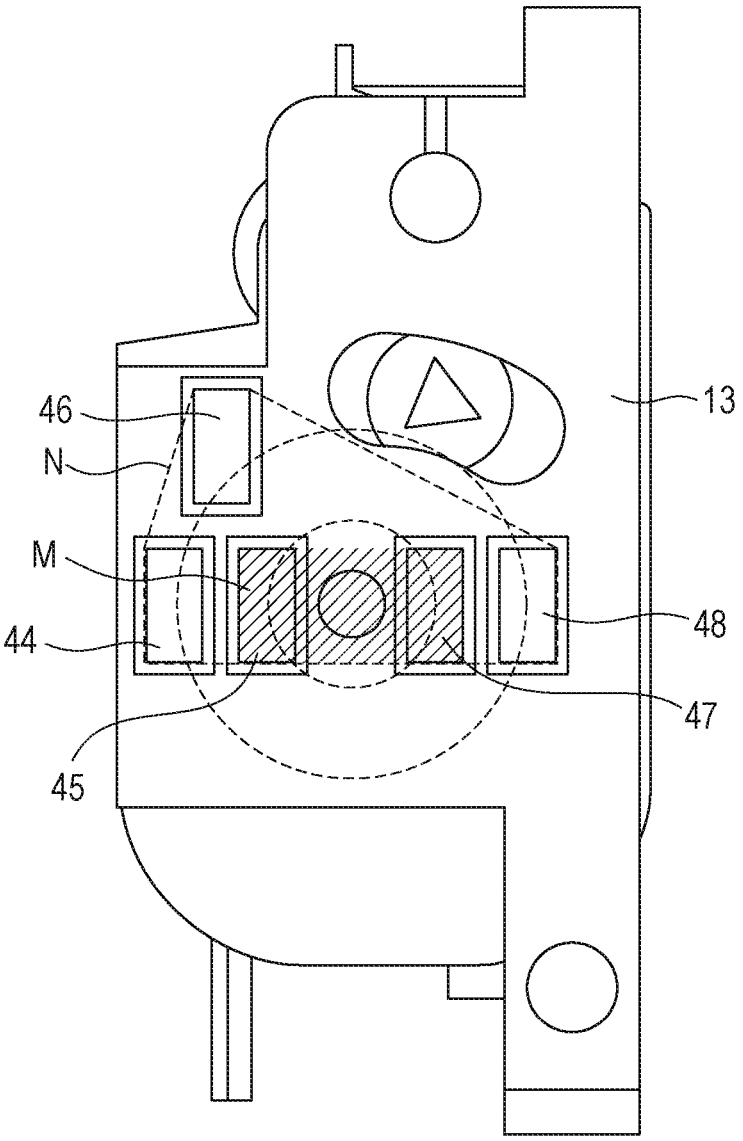
FIG. 16 is a configuration diagram of a modification of the developing cartridge according to the first embodiment.

FIG. 16 illustrates a modification suitable for furthering the advantages of the above-described embodiment. The toner supply roller contact point 45 and residual toner detection contact point 47 are formed on a same circle of which the axis Y is the center, i.e., equidistantly from the axis Y. The axis Y is also disposed within a polygon (hatched portion N) formed by the outer shapes of the toner supply roller contact point 45 and residual toner detection contact point 47 and straight lines connecting these outer shapes. Thus, the toner supply roller contact point 45 and residual toner detection contact point 47 are disposed facing each other across the axis Y at the center, and further equidistantly from the axis Y. Consequently, the developing frame 31 is pressured by the main body side electric contact points 40 and 42 disposed symmetrically as to the axis Y, so the developing frame 31 can be suppressed from inclining as to the axis Y by the urging force of the main body side electric contact points 40 and 42.

FIG. 16 also illustrates an arrangement where the developing roller contact point 44 and residual toner detection contact point 48 are formed on a same circle of which the axis Y is the center, i.e., equidistantly from the axis Y. The axis Y is also disposed within a polygon (dashed line portion N) formed by the outer shapes of the developing roller contact point 44, developing blade contact point 46, and residual toner detection contact point 48, and straight lines connecting these outer shapes. Thus, the developing roller contact point 44, developing blade contact point 46, and residual toner detection contact point 48 are disposed facing each other across the axis Y at the center, and further equidistantly from the axis Y. Consequently, the developing frame 31 is pressured by the main body side electric contact points 39 and 43 disposed symmetrically as to the axis Y, so the developing frame 31 can be suppressed from inclining as to the axis Y by the urging force of the main body side electric contact points 39 and 43.

According to the present embodiment as described above, stable electric power supply can be performed with suppressed inclination of the developing frame as to the pivot axis. Also, suppressing inclination of the developing frame as to the pivot axis further enables sliding resistance of the pivoting portions to be reduced, so the developing roller can be pressured against the photosensitive drum in a stable manner.

Second Embodiment

Next, a second embodiment will be described with reference to FIG. 17. Description has been made in the first embodiment where the front-side end member 37 and back-side end member 38 are disposed at the ends of the developing frame 31 in the axial direction of the developing roller. In comparison with this, a feature of the present embodiment is that only the front-side end member 37 is provided. Description will be made in the present embodiment regarding only configuration portions that differ from the first embodiment, and description of configuration portions that are the same as the first embodiment will be omitted.

Figure 17:
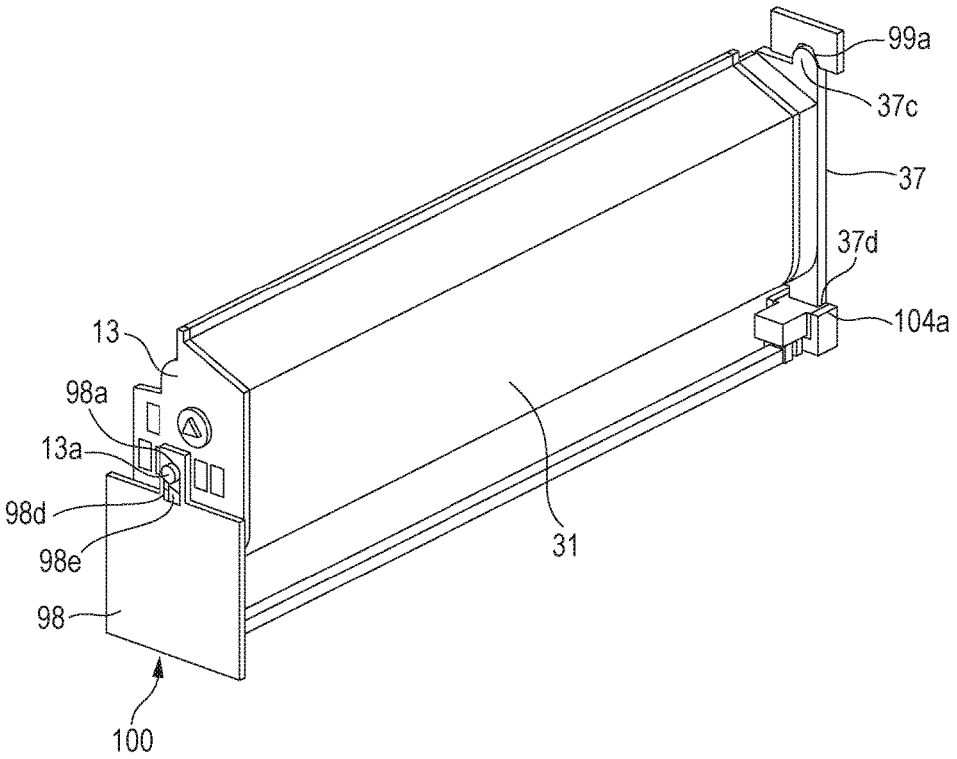
FIG. 17 is a configuration explanatory diagram illustrating a state in which a developing cartridge according to a second embodiment is positioned as to the image forming apparatus main body.

FIG. 17 is a perspective view illustrating a state where the developing cartridge 4 is mounted to the apparatus main body 100A. The boss 13*a* provided to the developing unit rear bearing 13 is pressured upwards in the vertical direction by a main body pressuring member 98*d* and a main body pressuring spring 98*e* provided to the back-side plate 98, and comes into contact with the positioning portion 98*a* provided to the back-side plate 98. Accordingly, the front side of the developing frame 31 is turnably (pivotably) supported by the front-side end member 37, and the back side thereof by the back-side plate 98. Advantages the same as those of the first embodiment can be obtained by this configuration as well.

Third Embodiment

Next, a third embodiment will be described with reference to FIGS. 18 and 19. Description has been made in the first embodiment where the drum cartridge and developing cartridge (developing device) are separate configurations. In comparison with this, a feature of the present embodiment is that the drum cartridge (photosensitive unit) and developing cartridge are an integrated process cartridge.

A process cartridge here is an arrangement where part or all of a photosensitive drum and process arrangements that act upon this drum are formed into an integrated cartridge that is detachably mountable to the apparatus main body. Examples of process arrangements include a charging arrangement, developing arrangement, cleaning arrangement, and so forth, that act upon the photosensitive drum. Description will be made in the present embodiment regarding only configuration portions that differ from the first embodiment, and description of configuration portions that are the same as the first embodiment will be omitted.

Figure 18:
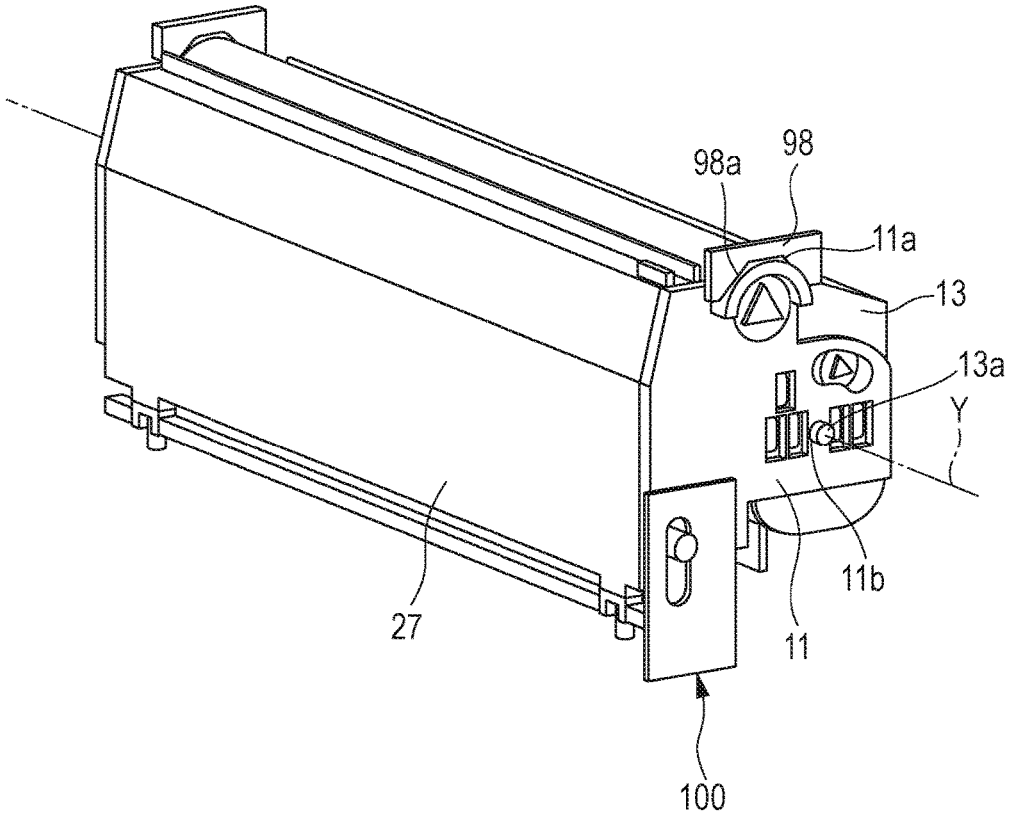
FIG. 18 is a configuration explanatory diagram illustrating a state in which a process cartridge according to a third embodiment is positioned as to the image forming apparatus main body.
Figure 19:
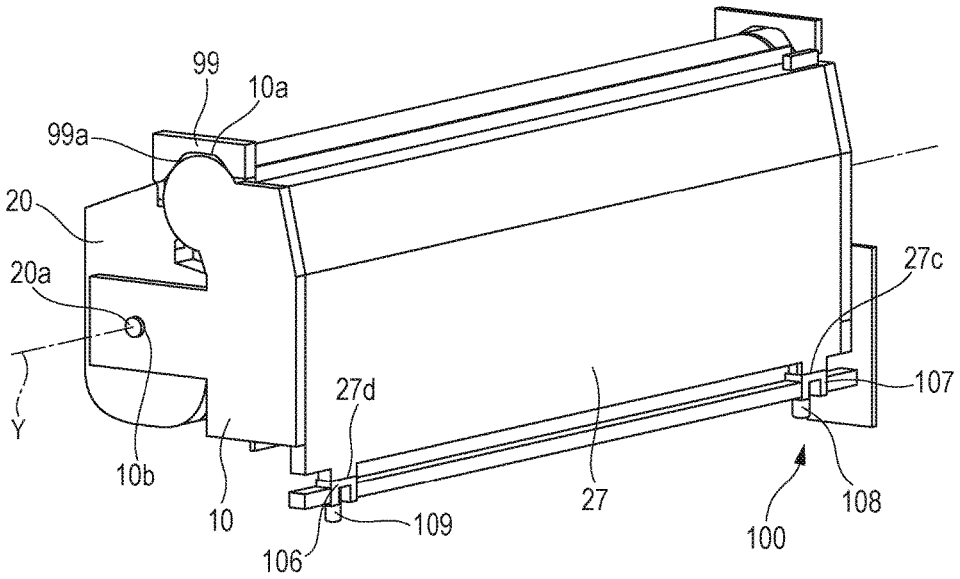
FIG. 19 is a configuration explanatory diagram illustrating a state in which a process cartridge according to the third embodiment is positioned as to the image forming apparatus main body.
Figure 20A:
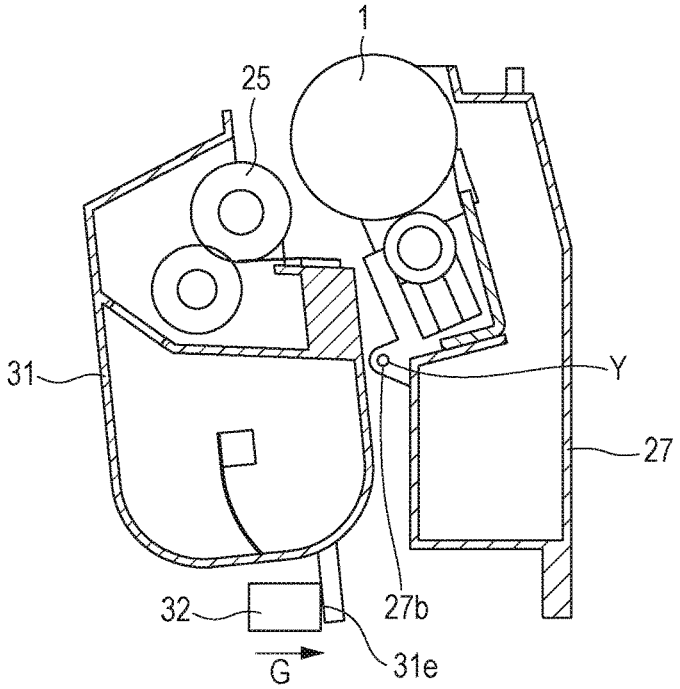
FIGS. 20A and 20B are configuration explanatory diagrams for describing a contact/separation configuration in a conventional configuration.
Figure 20B:
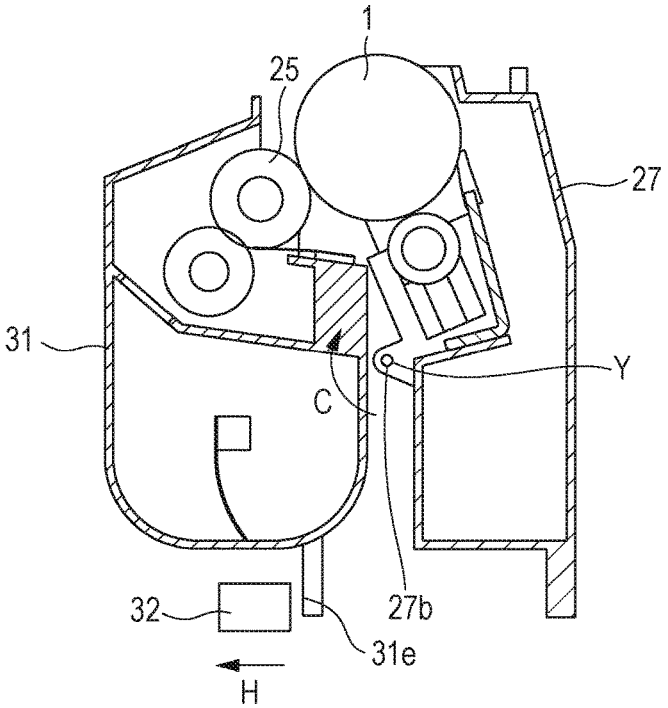

FIGS. 18 and 19 are perspective views illustrating a state where a process cartridge, in which the drum cartridge and developing cartridge according to the first embodiment have been integrated, is mounted to the apparatus main body 100A. In the process cartridge according to the present embodiment, a front-side pressured portion 27*c* and a back-side pressured portion 27*d* are pressured upwards vertically by the back-side main body pressuring member 106, back-side pressuring spring 109, front-side main body pressuring member 107, and front-side pressuring spring 108, provided to the apparatus main body. The process cartridge is also positioned as to the apparatus main body 100A by a positioning portion 11*a* of the drum-rear bearing 11 coming into contact with the positioning portion 98*a* of the back-side plate 98, and a positioning portion 10*a* of the drum-front bearing 10 coming into contact with the positioning portion 99*a* of the front-side plate 99.

In addition, the drum-front bearing 10 and drum-rear bearing 11 are provided overlaying the axis Y in a plane perpendicular to the axis Y that is the pivot axis. The boss 13*a* provided to the developing unit rear bearing 13 engages a suspending hole 11*b* of the drum-rear bearing 11. The boss 20*a* of the gear cover 20 also engages a suspending hole 10*b* of the drum-front bearing 10. Accordingly, the developing frame 31 is rotatably supported by the cleaning frame 27. Advantages the same as those of the first embodiment can be obtained by this configuration as well.

Modifications

Although exemplary embodiments have been described above, aspects of the present invention are not restricted to these, and various modifications may be made within the scope of the present invention.

While aspects of the present invention have been described with reference to exemplary embodiments, it is to be understood that aspects of the invention are not limited to the disclosed exemplary embodiments. The scope of the following claims is to be accorded the broadest interpretation so as to encompass all such modifications and equivalent structures and functions.

This application claims the benefit of Japanese Patent Application No. 2017-011091 filed Jan. 25, 2017, which is hereby incorporated by reference herein in its entirety.

What is claimed is:

1. A developing device that is detachably mountable to an image forming apparatus main body, the developing device comprising:

a developing frame configured to contain a developer;

a developing roller configured to perform developing using the developer; and a plurality of electric contact points disposed at one end in an axial direction of the developing roller, on a face that intersects the axial direction, wherein the developing device is pivotably centered on a pivot axis parallel to the axial direction of the developing roller, and electrically conducts with the image forming apparatus main body via the plurality of electric contact points when mounted to the image forming apparatus main body, and wherein, in a plane perpendicular to the axial direction of the developing roller, a position of the pivot axis is within a polygon having a greatest area formed of outer shapes of the plurality of electric contact points and straight lines connecting the outer shapes of the multiple electric contact points.

2. The developing device according to claim 1, wherein a center of gravity of the developing frame is within a region of the polygon in the plane perpendicular to the axial direction of the developing roller.

3. The developing device according to claim 1, further comprising:

a supporting member configured to support the developing roller at an end in the axial direction of the developing roller, wherein the plurality of electric contact points are provided to the supporting member.

4. The developing device according to claim 3, wherein the supporting member pivotably supports the developing frame, centered on the pivot axis.

5. The developing device according to claim 1, wherein the plurality of electric contact points are disposed on a same circle centered on the pivot axis in a plane that intersects the axial direction.

6. The developing device according to claim 1, wherein the developing frame is turnably supported by an end member provided at each side in the axial direction of the developing roller.

7. The developing device according to claim 1, wherein the developing frame is supported by an end member provided at one side in the axial direction of the developing roller, and a side plate provided to the image forming apparatus main body.

8. An image forming apparatus, comprising:

an image forming apparatus main body; and a developing device detachably mountable to the image forming apparatus main body, the developing device comprising:

a developing frame configured to contain a developer;

a developing roller configured to perform developing using the developer; and a plurality of electric contact points disposed at one end in an axial direction of the developing roller, on a face that intersects the axial direction, wherein the developing device is pivotably centered on a pivot axis parallel to the axial direction of the developing roller, and electrically conducts with the image forming apparatus main body via the plurality of electric contact points when mounted to the image forming apparatus main body, and wherein, in a plane perpendicular to the axial direction of the developing roller, a position of the pivot axis is within a polygon having a greatest area formed of outer shapes of the plurality of electric contact points and straight lines connecting the outer shapes of the multiple electric contact points.

9. A process cartridge comprising:

a photosensitive unit having a photosensitive drum; and a developing device including:

a developing frame configured to contain a developer;

a developing roller configured to perform developing using the developer; and a plurality of electric contact points disposed at one end in an axial direction of the developing roller, on a face that intersects the axial direction, wherein the developing device is pivotably centered on a pivot axis parallel to the axial direction of the developing roller, and electrically conducts with an image forming apparatus main body via the plurality of electric contact points when mounted to the image forming apparatus main body, wherein, in a plane perpendicular to the axial direction of the developing roller, a position of the pivot axis is within a polygon having a greatest area formed of outer shapes of the plurality of electric contact points and straight lines connecting the outer shapes of the multiple electric contact points, and wherein the photosensitive unit and the developing device are integrated and arranged to be detachably mountable to the image forming apparatus main body.

10. An image forming apparatus, comprising:

the process cartridge according to claim 9; and the image forming apparatus main body to which the process cartridge is detachably mountable.

* * * * *